United States Patent [19]

Colvin

[11] 4,325,275

[45] * Apr. 20, 1982

[54] ADJUSTABLE OPEN-END AND BOX-END WRENCH

[76] Inventor: David S. Colvin, 31324 Burbank, Farmington Hills, Mich. 48018

[ * ] Notice: The portion of the term of this patent subsequent to May 1, 1996, has been disclaimed.

[21] Appl. No.: 143,052

[22] Filed: Apr. 23, 1980

[51] Int. Cl.[3] ..... B25B 13/10; B25B 13/18

[52] U.S. Cl. ..... 81/77; 81/128

[58] Field of Search ..... 81/77, 112, 128, 134, 81/172

[56] References Cited

U.S. PATENT DOCUMENTS

| | | | |
|---|---|---|---|
| 1,561,812 | 11/1925 | White | 81/128 |
| 1,585,825 | 5/1926 | Bessolo | 81/134 X |
| 1,781,994 | 11/1930 | Wilson | 81/134 X |
| 2,486,523 | 11/1949 | Deschenes | 81/128 X |
| 2,814,226 | 11/1957 | Lojcyc | 81/128 |
| 3,673,896 | 7/1972 | Vardaman | 81/172 X |
| 4,065,986 | 1/1978 | Meggs et al. | 81/128 |
| 4,151,763 | 5/1979 | Colvin | 81/77 |

*Primary Examiner*—James G. Smith

*Attorney, Agent, or Firm*—Reising, Ethington, Barnard, Perry & Brooks

[57] ABSTRACT

An adjustable open-end and box-end wrench (10) is provided as including an improved mounting arrangement for a pair of jaws (20) of the open-end of the wrench. A pair of longitudinally spaced pins (40) on a housing (16) of the wrench are respectively received within a pair of skewed slots (42) in each jaw so as to provide opening or closing lateral movement of the jaws upon longitudinal movement thereof within the housing. An adjusting member (24) having an engagement surface (26) that cooperates with a box structure (22) to provide the box-end of the wrench is connected to the jaws (20) and selectively secured by a lock mechanism (18) to lock both ends of the wrench in any adjusted position. In one embodiment, a slideway (54) on the housing (16) mounts the adjusting member (24) for pivotal movement about a lateral axis so as to engage and disengage a pawl (56) and ratchet (58) between the housing and the adjusting member to selectively provide the locking. In another embodiment, an adjusting nut (80) receives threads (82) on the adjusting member (24) and is received within an opening (83) in the housing for rotation that provides the adjusting movement. In both embodiments, the wrench housing (16) includes flared ends (46) on side walls thereof with flared slide surfaces (48) engaged by slide surfaces (50) on the outer jaw ends so as to provide jaw support during use.

16 Claims, 10 Drawing Figures

ADJUSTABLE OPEN-END AND BOX-END WRENCH

TECHNICAL FIELD

This invention relates generally to an adjustable open-end and box-end wrench for turning nuts, bolt heads, and the like.

BACKGROUND ART

As discussed in U.S. Pat. No. 4,151,763 the entire disclosure of which is hereby incorporated by reference, the most common type of adjustable wrench includes a first fixed jaw and a second jaw that is movable with respect to the fixed jaw by a rotatable screw in order to control the spaced relationship between engagement surfaces of the jaws. Some disadvantages of such a wrench include: (1) the time involved manipulation required to move the wrench by screw rotation between fully opened and fully closed positions; (2) difficulty in maintaining the screw at a fixed position without any slight rotation that enlarges the spaced relationship between the jaw surfaces and permits rounding of the corners of a nut or bolt head being torqued; and (3) the necessary positioning of the rotatable screw adjacent the jaws and the consequent relatively wide width thereof which makes it somewhat inconvenient or impossible for the wrench to be utilized in certain confined areas.

The aforementioned U.S. Pat. No. 4,151,763 discloses an open-end and box-end wrench that is: (1) easily and quickly adjusted between its fully opened and fully closed positions at each end thereof; (2) fixed in any adjusted position thereof by a lock mechanism to prevent opening movement that can round corners of a nut or bolt head being torqued; and (3) useable in relatively confined areas due to the construction thereof which permits a relatively narrow width of the jaws at the open-end of the wrench.

DISCLOSURE OF INVENTION

An object of the present invention is to provide an improved adjustable open-end and box-end wrench having a construction that is relatively easy to manufacture and assemble and which is easy to use and highly effective in performance. In carrying out this object, the wrench disclosed has an improved mounting construction for a pair of jaws with engagement surfaces that oppose each other in a parallel relationship to cooperatively provide the adjustable open-end of the wrench. An improved lock mechanism is also disclosed for locking an adjusting member which has one end with an engagement surface for cooperating with a box structure on a housing of the wrench to provide the adjustable box-end thereof, and a second end of the adjusting member is connected to the jaws to provide locking of the jaws along with the adjusting member.

The wrench in which the invention is incorporated has the housing thereof provided with an elongated shape of a hollow construction in which the jaws of the open-end thereof and the adjusting member of the box-end thereof are received. Longitudinal movement of the adjusting member and the jaws connected thereto simultaneously adjusts the size nut or bolt head which can be gripped by the open-end or box-end of the wrench.

Mounting of the pair of jaws is provided in accordance with this invention by a pair of pins which are mounted on the housing spaced longitudinally therealong adjacent inner ends of the jaws which are received within the housing. Each jaw includes a pair of slots that respectively receive the pair of pins and which extend parallel to each other in a skewed relationship with respect to the longitudinal axis of the housing and in the opposite direction as the slots of the other jaw. Longitudinal movement of the adjusting member and the jaws moves the jaws laterally as a result of the dual pin and skewed slot mounting thereof in order to adjustably control the size nut or bolt head that can be gripped by the parallel engagement surfaces on the outer ends of the jaws. Interengaged slide surfaces on the housing and the jaws at the open-end of the wrench cooperate with the pins and slots to position the jaws in any adjusted position thereof with the engagement surfaces maintained in their parallel relationship so as to permit jaw gripping and torquing of a nut or bolt head of the size to which the wrench is adjusted.

The housing of the wrench in which the invention is incorporated includes a pair of side walls spaced from each other a uniform distance between the ends of the housing. At the open-end of the wrench, the housing side walls have flared ends adjacent the outer ends of the jaws on which the engagement surfaces are located. The flared ends of the housing side walls each have a slide surface and the outer end of each jaw has a slide surface that is slidably engaged with one of the slide surfaces on the housing side walls. The slide surfaces define an outwardly flared shape for supporting the jaws in any adjusted position. The flared shape defined by the ends of the housing side walls permits the slide surfaces thereof to have a greater length then would otherwise be possible so as to provide greater support to the jaws against deflection at the engagement surfaces thereof regardless of the manner in which the inner ends of the jaws are supported for the longitudinal and lateral movement. The lock mechanism of the wrench for locking the adjusting member and the jaws against longitudinal movement thus cooperates with the flared slide surfaces in supporting the jaws in any adjusted position.

Mounting of the wrench jaws by the dual pin and skewed slot construction disclosed in cooperation with the flared ends on the housing side walls provides best results in achieving ease of manufacturing and assembly as well as effectiveness in use.

In one preferred embodiment of the wrench, a slideway on the housing mounts the adjusting member adjacent the engagement surface thereof for longitudinal movement and selective pivotal movement about a lateral axis parallel to the lateral direction in which the jaws move. A slidable connection between the adjusting member and the inner ends of the jaws permits the selective pivoting of the adjusting member by a manual actuation. The lock mechanism of this embodiment includes a pawl and ratchet that are engaged and disengaged between the housing and the adjusting member upon the pivoting of the adjusting member in order to selectively fix the longitudinal position of the adjusting member and the jaws and thereby control the sizes of nuts or bolt heads which can be gripped by either the open-end or the box-end of the wrench.

The pawl and ratchet type lock mechanism of the wrench preferably has ratchet teeth positioned on the housing and a pawl on the adjusting member as well as a leaf spring that biases the adjusting member to engage the pawl thereon with the ratchet teeth on the housing. In one version, the ratchet teeth are spaced along the elongated extent of the housing at varying distances therebetween and the pawl on the adjusting member includes a single pawl tooth that is engageable with the teeth of the ratchet to lock the adjusting member and the jaws in order to permit gripping of either English or metric size nuts or bolt heads. In another version, the ratchet includes relatively small teeth spaced along the elongated extent of the housing with uniform distances therebetween and the pawl on the adjusting member includes a plurality of pawl teeth that are simultaneously engageable with adjacent ratchet teeth on the housing to lock the adjusting member and the jaws in order to provide essentially infinite position gripping of any size nut or bolt head.

In another embodiment, the lock mechanism includes an adjusting nut and threads on the adjusting member for threadingly receiving the adjusting nut. An opening in the housing receives the adjusting nut such that rotation thereof moves the adjusting member and the jaws longitudinally within the housing to provide adjustment of the size of nuts or bolt heads which can be clamped by either end of the wrench. In this embodiment, the adjusting nut is positioned within the housing opening and rotated as the adjusting member is inserted thereinto during assembly.

The housing of the wrench can be manufactured with either a unitary or a two piece construction. When made with the unitary construction, the housing preferably comprises an investment casting. Manufacturing of the pawl and ratchet type lock mechanism is facilitated by making of the housing as a unitary investment casting since the ratchet teeth can then be cast on an inner surface of the housing without requiring any particularly involved operation. Also, the unitary housing is preferably provided with an adjustment button opening when the lock mechanism thereof is of the pawl and ratchet type, and an adjustment button of the wrench is mounted on the adjusting member after insertion thereof into the housing during assembly. In its two piece construction, the housing includes a main portion and a cover that cooperate to define the hollow construction in which the adjusting member and the jaws are received. The main portion of the housing includes a base and spaced side walls extending in a unitary relationship from the base. A support portion of the main portion of the housing extends between the side walls unitary therewith adjacent the slide surfaces at the outer ends of the jaws in order to provide support that prevents jaw deflection during torquing of a nut or bolt head. The cover extends between the side walls in a spaced relationship to the base to define the hollow construction of the housing.

Indicia is also provided on the housing and the adjusting member to visually indicate the size nut or bolt head that can be gripped by either the open-end or box-end of the wrench in any adjusted position.

The above object and other objects, features, and advantages of the present invention are readily apparent from the following detailed description of the best modes for carrying out the invention when taken in connection with the accompanying drawings.

BEST MODES FOR CARRYING OUT THE INVENTION

Figures 1, 2, 3, 4:
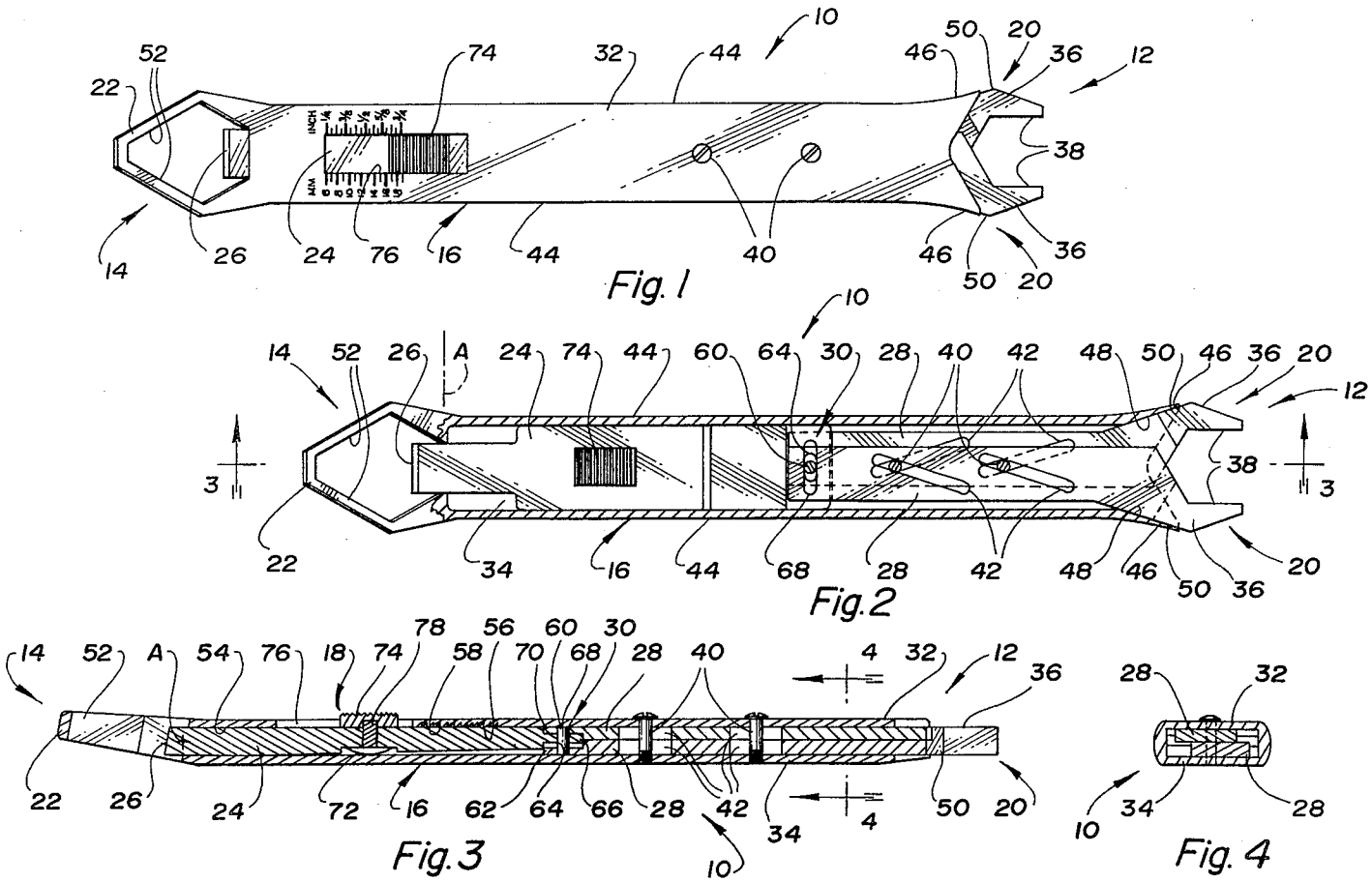
FIG. 1 is a plan view of an adjustable open-end and box-end wrench constructed in accordance with the present invention.
FIG. 2 is a view similar to FIG. 1 but partially broken away to illustrate the construction of the wrench.
FIG. 3 is a sectional view of the wrench taken in a longitudinal direction along line 3—3 of FIG. 2.
FIG. 4 is a cross sectional view of the wrench taken along line 4—4 of FIG. 3.

Referring to FIGS. 1 through 4 of the drawings, one embodiment of an adjustable wrench constructed in accordance with the present invention is indicated by reference numeral 10 and includes an open-end wrench 12 and a box-end wrench 14 which are connected by an elongated housing 16 that forms a handle of the wrench. A lock mechanism 18 (FIG. 3) selectively locks the wrench in any adjusted position thereof as is hereinafter more fully described. Adjustment of the wrench under the control of the lock mechanism 18 simultaneously adjusts both the open-end 12 and box-end 14 thereof in order to permit gripping of a nut or bolt head of the same size by each wrench end. Open-end wrench 12 includes a pair of jaws 20 that are movable longitudinally with respect to the elongated extent of the housing 16 as well as laterally with respect thereto in order to provide opening and closing of the wrench end. Box-end wrench 14 includes a box structure 22 on the housing 16 and an adjusting member 24 received within the housing and having an outer engagement surface 26 for cooperating with the box structure to grip nuts or bolt heads of different sizes depending upon the adjusted longitudinal position of the adjusting member within the housing. Connection of the jaws 20 of the open-end wrench 12 and the adjusting member 24 of the box-end wrench 14 provides for the simultaneous adjustment of both of the wrench ends.

With specific reference to FIGS. 2, 3, and 4, the jaws 20 of the open-end wrench 12 have inner ends 28 that are received within the hollow housing 16 for longitudinal and lateral movement with respect to the housing. A slidable connection 30 between the inner jaw ends 28 and the adjusting member 24 provides for the simultaneous longitudinal movement of these components in order to simultaneously adjust both wrench ends. Each inner jaw end 28 has a thickness just slightly less than the spacing between upper and lower walls 32 and 34 of the housing 16 so that insertion thereof can be performed during assembly of the wrench. Outer ends 36 of the jaw 20 have thickened portions defining engagement surfaces 38 that oppose each other in a parallel relationship to provide gripping of a nut or bolt head between the jaws.

As seen in FIGS. 2 and 3, a pair of mounting pins 40 extend between the upper and lower housing walls 32 and 34, with a headed screw type securement as shown, and are respectively received within a pair of slots 42 within each jaw 20 at its inner end 28. The slots 42 of each jaw have rectilinear shapes extending parallel to each other in a skewed relationship with respect to the longitudinal axis of the housing and in the opposite direction as the slots of the other jaw. The dual pin and skewed slot mounting of the jaws provides lateral movement thereof along with the longitudinal jaw movement such that the engagement surfaces 38 of the jaws move toward or away from each other while maintaining the parallel relationship between these surfaces.

With reference to FIGS. 1 and 2, the wrench housing 16 includes side walls 44 that are spaced from each other a uniform distance between the ends of the wrench. Adjacent the open-end wrench 12, the housing side walls 44 include flared ends 46 whose distal extremities are spaced farther from each other than the intermediate portions of the side walls. Flared slide surfaces 48 (FIG. 2) on the housing side walls ends are respectively engaged by slide surfaces 50 on the outer ends 36 of the jaws 20 in order to provide support thereto during torquing of a nut or bolt head between the engagement surfaces 38. As the jaws 20 are moved longitudinally and laterally by the dual pin 40 and slot 42 mounting thereof, the surfaces 50 slide along the housing surfaces 48 and are supported thereby in any adjusted position. The flared shape of the adjacent housing ends permits the surfaces 48 to have a greater length than would otherwise be possible in order to provide greater support to the jaws and consequent greater resistance to deflection.

As seen in FIGS. 1 and 2, box-end wrench 14 has its box structure 22 provided with fixed engagement surfaces 52 that define a 60° angle therebetween so as to cooperate with the engagement surface 26 on the movable adjusting member 24 to provide gripping of a nut or bolt head by the box-end wrench. Housing 16 defines a slideway 54 (FIG. 3) which supports the adjusting member 24 for longitudinal movement adjacent its engagement surface 26. Adjusting member 24 has a somewhat tapered shape from its left end toward its right end so as to be pivotally supported by housing slideway 54 for selective movement about an axis A that extends in a lateral direction parallel to the lateral direction of the jaw movement.

Lock mechanism 18 illustrated in FIG. 3 includes a pawl 56 and a ratchet 58 that are selectively engaged and disengaged by the pivotal movement of adjusting member 24 in order to selectively fix the longitudinal position of the adjusting member and the jaws 20 in any adjusted position. The slidable connection 30 between the adjusting member 24 and the inner jaw ends 28 includes a pin 60 that is received within a slot 61 in a tab 62 of the lower jaw extending upwardly through a lateral slot 64 in a tab 66 on the adjusting member and through a lateral slot 68 in a tab 70 on the upper jaw. Tab 62 and 70 are spaced from each other a sufficient distance greater than the thickness of the tab 66 in order to permit the pivoting of the adjusting member for engagement and disengagement of the pawl 56 and ratchet 58. Upon disengagement of the pawl 56 with the ratchet 58, the adjusting member 24 is movable longitudinally and the connection 30 then allows the lateral movement of the jaws 20 as pin 60 slides within the slots 64 and 68. A curved leaf spring 72 is received within a recess in the lower side of the adjusting member 24 to provide a counterclockwise bias thereof about axis A in order to normally engage the pawl 56 with the ratchet 58. An adjustment button 74 which is received within an associated opening 76 in the upper housing wall 32 is manually movable by the user's thumb to pivot the adjusting member 24 against the bias of spring 72 in order to disengage the pawl 56 from the ratchet 58 for the longitudinal adjusting movement.

Wrench 10 shown in FIGS. 1 through 4 is assembled prior to mounting of the adjustment button 74 on the adjusting member 24 and prior to threading of the mounting pins 40 onto the housing. The adjusting member 24 with the jaws 20 secured thereto by connection 30 are inserted through the right open-end of the housing 16 to the position shown and the pins 40 are then secured in position on the housing and the button 74 is mounted on the adjusting member in any suitable manner such as by a press fit on a pin 78. The wrench can then be used for adjustment to any required size in the manner previously described, such that longitudinal movement toward the right opens both wrench ends while longitudinal movement toward the left closes both wrench ends.

Figure 5:
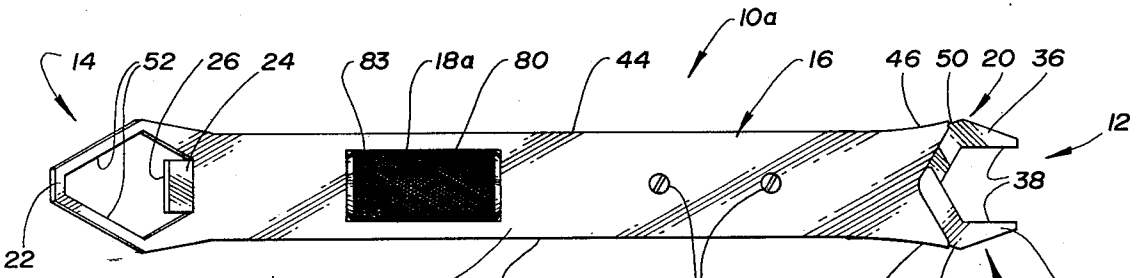
FIG. 5 is a plan view of another embodiment of an adjustable open-end and box-end wrench constructed in accordance with the present invention.
Figure 6:
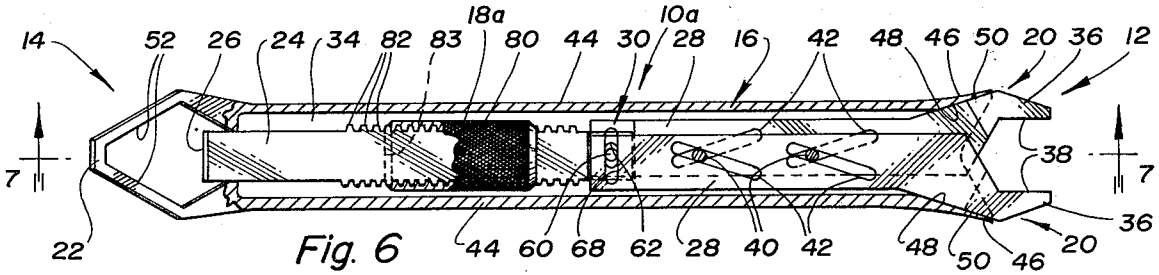
FIG. 6 is a view similar to FIG. 5 but partially broken away to illustrate the construction of the wrench.
Figure 7:
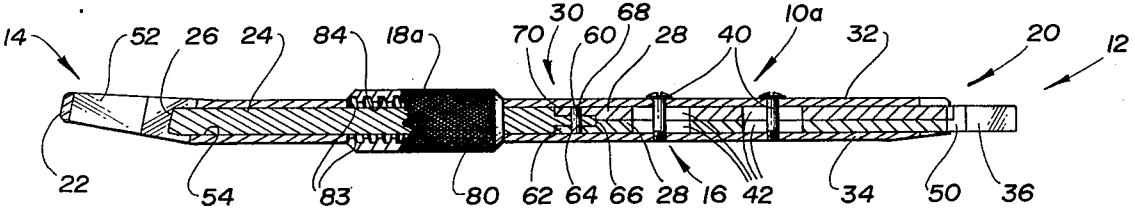
FIG. 7 is a sectional view of the wrench taken in a longitudinal direction along line 7—7 of FIG. 6.

Referring to FIGS. 5, 6, and 7, another embodiment of an adjustable open-end and box-end wrench according to the present invention is indicated generally by reference numeral 10*a* and is similar to the previously described embodiment such that like reference numerals are applied to like components thereof and much of the previous description is therefore applicable except as will be noted. The basic difference between wrench 10*a* and the previously described wrench embodiment is that the lock mechanism 18*a* utilizes an adjusting nut 80 rather than the pawl and ratchet previously described. Adjusting member 24 of this wrench is provided with threads 82 (FIG. 6) that receive mating threads 84 (FIG. 7) on the nut 80. An opening 83 in both the upper and lower housing walls 32 and 34 receives the nut 80 such that rotation thereof provides the longitudinal movement of the adjusting member 24 and the jaws 20 secured thereto by the connection 30. Adjusting member 24 in this embodiment thus does not have to pivot in the manner disclosed with the pawl and ratchet embodiment and, as such, the tab 66 on the adjusting member thus is engaged with both the lower and upper tabs 62 and 70 at which the connection pin 60 is mounted and operable to coordinate the longitudinal adjusting member and jaw movement while permitting the lateral jaw movement.

Figure 8:
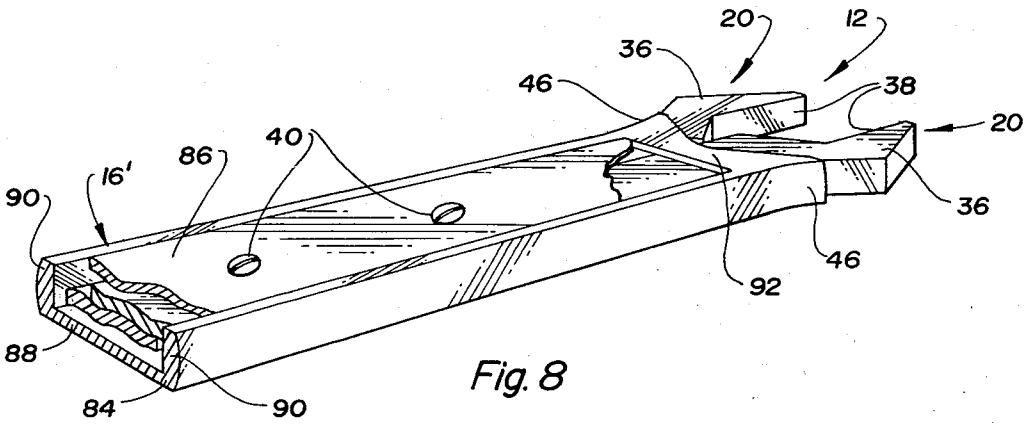
FIG. 8 is a perspective view which illustrates a two piece housing that can be utilized rather than the unitary housing construction illustrated in both the embodiment of FIGS. 1 through 4 and the embodiment of FIGS. 5 through 7.

The housings 16 of both the wrench 10 shown in FIGS. 1 through 4 and the wrench 10*a* shown in FIGS. 5 through 7 are preferably made with a unitary construction that can best be provided by an investment casting for ease in manufacturing as well as low cost. However, as illustrated in FIG. 8, it is also possible for either embodiment of the wrench to have a housing 16' with a two piece construction including a main housing portion 84 and a cover 86 that cooperate to define the hollow construction of the housing. Main housing portion 84 has a base 88 and side walls 90 projecting upwardly from the base in a unitary manner such that the cover 86 extends between the upper edges of the side walls. At its open-end wrench 12, the main housing portion 84 includes a unitary support portion 92 extending between the side walls 90 in order to provide additional support to the outer jaw ends 36 against deflection away from each other. This two piece housing construction can be manufactured by a suitable machining process and is useful in facilitating manufacturing of the ratchet type lock mechanism when it is decided for manufacturing reasons that the ratchet thereof should be machined.

Figure 10:
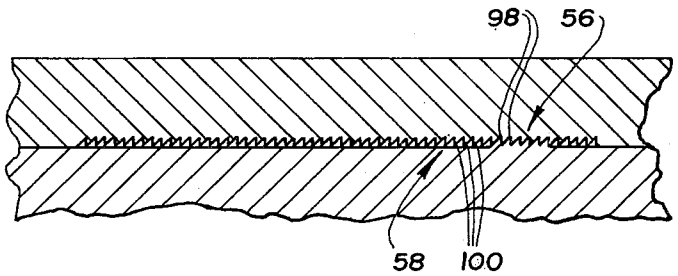
FIG. 10 is also taken in the same direction as FIG. 3 and illustrates another version of a pawl and ratchet of the lock mechanism of the wrench.
Figure 9:
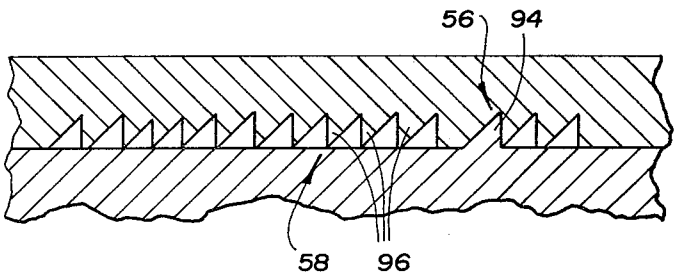
FIG. 9 is a sectional view taken in the same direction of FIG. 3 and illustrates one version of a pawl and ratchet of a lock mechanism of the wrench.

Two different versions of the pawl 56 and the ratchet 58 are illustrated in FIGS. 9 and 10. In FIG. 9, the pawl 56 comprises a single pawl tooth 94 that is engageable with ratchet teeth 96 spaced longitudinally along the housing 16 at varying distances in order to permit adjustment of the wrench for gripping of both English and metric size nuts or bolt heads. In FIG. 10, the pawl 56 includes a plurality of smaller pawl teeth 98 and the ratchet 58 includes smaller ratchet teeth 100 spaced uniformly along the length of the housing 16 so as to be engageable by the pawl teeth and thereby provide a wrench that has essentially infinite position adjustment capability for gripping nuts or bolts of any size. It should also be noted that either version of the ratchet 58 can be conveniently manufactured by investment casting to provide a relatively low cost but yet highly effective wrench.

As seen in FIG. 1, the left end of adjustment button 74 on adjusting member 24 and markings on the housing wall 32 at each side of opening 76 cooperatively provide indicia for indicating the adjusted position of the wrench in both English and metric units. As illustrated, the wrench is adjustable between ¼ inch and ¾ inch on the English scale, which is a good range for normal use. However, it is of course understood that other selected ranges can be used if desired.

While the best modes for carrying out the invention have herein been described in detail, those skilled in the art to which this invention relates will recognize various alternative designs and embodiments for practicing the invention as defined by the following claims.

What is claimed is:

1. In an adjustable open-end and box-end wrench including an elongated housing of a hollow construction, a polygonal box structure on one end of the housing, an adjusting member received within the housing for longitudinal movement with respect thereto and having an outer engagement surface for cooperating with the box structure to grip nuts and bolt heads of different sizes in accordance with the longitudinal position of the adjusting member so as to thereby provide an adjustable box-end wrench, and a pair of jaws having inner ends connected to the adjusting member within the housing for longitudinal movement therewith and having outer ends with associated engagement surfaces that oppose each other in a parallel relationship, the improvement comprising: a pair of pins mounted on the housing spaced longitudinally therealong adjacent the jaws; each jaw including a pair of slots that respectively receive the pair of pins; the slots of each jaw extending parallel to each other in a skewed relationship to the longitudinal axis of the housing such that the longitudinal jaw movement is accomplished by lateral movement of the jaw engagement surfaces toward or away from each other while maintaining the parallel relationship therebetween in order to provide an adjustable open-end wrench; a lock mechanism for locking the adjusting member and the jaws against longitudinal movement to control the size of nuts or bolt heads that can be gripped by either the open-end or box-end of the wrench; and interengaged slide surfaces on the housing and each jaw at the open-end of the wrench for cooperating with the pins and slots to position the jaws in any adjusted position.

2. In an adjustable open-end and box-end wrench including an elongated housing of a hollow construction, said housing having a pair of side walls spaced from each other a uniform distance between the ends of the housing, a polygonal box structure on one end of the housing, an adjusting member received within the housing for longitudinal movement with respect thereto and having an outer engagement surface for cooperating with the box structure to grip nuts and bolt heads of different sizes in accordance with the longitudinal position of the adjusting member so as to thereby provide an adjustable box-end wrench, and a pair of jaws having inner ends connected to the adjusting member within the housing for longitudinal movement therewith and having outer ends with associated engagement surfaces that oppose each other in a parallel relationship, the improvement comprising: flared ends on the side walls of the housing adjacent the outer ends of the jaws; said flared ends of the housing side walls each having a slide surface; the outer end of each jaw having a slide surface that is slidably engaged with one of the slide surfaces on the ends of the housing side walls; said slide surfaces defining a flared shape; means mounting the inner end of each jaw so as to cooperate with the slide surfaces in supporting the jaws for concomitant lateral movement with the longitudinal movement whereby the engagement surfaces of the jaws move toward or away from each other while maintaining the parallel relationship therebetween in order to provide an adjustable open-end wrench; and a lock mechanism for locking the adjusting member and the jaws against longitudinal movement to control the size of nuts or bolt heads that can be gripped by either the open-end or box-end of the wrench.

3. In an adjustable open-end and box-end wrench including an elongated housing of a hollow construction, a polygonal box structure on one end of the housing, an adjusting member received within the housing for longitudinal movement with respect thereto and having an outer engagement surface for cooperating with the box structure to grip nuts and bolt heads of different sizes in accordance with the longitudinal position of the adjusting member so as to thereby provide an adjustable box-end wrench, a pair of jaws having inner ends connected to the adjusting member within the housing for longitudinal movement therewith and accompanying lateral movement with respect to each other, and each jaw having an outer end with an associated engagement surface that opposes the engagement surface of the other jaw in a parallel relationship that is maintained during the longitudinal and lateral jaw movement, the improvement comprising: a slideway on the housing for mounting the adjusting member adjacent the engagement surface thereof for longitudinal movement and selective pivotal movement about a lateral axis parallel to the lateral direction of jaw movement; a slidable connection between the adjusting member and the inner ends of the jaws so as to permit the selective pivoting of the adjusting member; a lock mechanism including a pawl and ratchet that are engaged and disengaged between the housing and the adjusting member upon pivoting of the adjusting member in order to selectively fix the longitudinal position of the adjusting member and the jaws and thereby control the sizes of nuts or bolt heads which can be gripped by either the open-end or box-end of the wrench; and interengaged slide surfaces on the housing and each jaw at the open-end of the wrench for cooperating with the lock mechanism to position the jaws in any adjusted position.

4. A wrench as in claim 1, 2, or 3 wherein the housing has a unitary construction.

5. A wrench as in claim 4 wherein the unitary housing comprises an investment casting.

6. A wrench as in claim 4 wherein the housing includes an opening, and an adjustment button received within the housing opening upon mounting thereof on the adjusting member after positioning of the adjusting member within the unitary housing.

7. A wrench as in claim 1, 2, or 3 wherein the housing includes a main portion and a cover that cooperate to define the hollow construction thereof, the main portion of the housing including a base and spaced side walls extending upwardly from the base unitary therewith, and the main portion of the housing also including a support portion extending between the side walls unitary therewith adjacent the slide surfaces of the housing in order to provide support to the jaws during torquing of a nut or bolt head.

8. A wrench as in claim 1 or 2 wherein the lock mechanism comprises a pawl and ratchet.

9. A wrench as in claim 1 or 2 wherein the lock mechanism comprises an adjusting nut, threads on the adjusting member for threadingly receiving the adjusting nut, and an opening in the housing for receiving the adjusting nut such that rotation thereof moves the adjusting member and hence the jaws longitudinally within the housing.

10. A wrench as in claim 1, 2, or 3 wherein the lock mechanism comprises a ratchet on the housing and a pawl on the adjusting member, and a leaf spring that biases the adjusting member to engage the pawl thereon with the ratchet on the housing.

11. A wrench as in claim 10 wherein the ratchet includes teeth spaced along the elongated extent of the housing at varying distances therebetween, and the pawl on the adjusting member including a single pawl tooth that is engageable with the teeth of the ratchet on the housing to lock the adjusting member and the jaws against longitudinal movement within the housing.

12. A wrench as in claim 10 wherein the ratchet includes teeth spaced along the elongated extent of the housing with uniform distances therebetween, and the pawl on the adjusting member including a plurality of pawl teeth that are simultaneously engageable with adjacent ratchet teeth on the housing to lock the adjusting member and the jaws against longitudinal movement within the housing.

13. A wrench as in claim 1, 2, or 3 further including indicia on the housing and on the adjusting member for indicating the size nut or bolt head that can be gripped by either the open-end or box-end of the wrench in any adjusted position thereof.

14. In an adjustable open-end and box-end wrench including an elongated housing of a hollow construction, said housing having a pair of side walls spaced from each other a uniform distance between the ends of the housing, a polygonal box structure on one end of the housing, an adjusting member received within the housing for longitudinal movement with respect thereto and having an outer engagement surface for cooperating with the box structure to grip nuts and bolt heads of different sizes in accordance with the longitudinal position of the adjusting member so as to thereby provide an adjustable box-end wrench, and a pair of jaws having inner ends connected to the adjusting member within the housing for longitudinal movement therewith and having outer ends with associated engagement surfaces that oppose each other in a parallel relationship, the improvement comprising: a pair of pins mounted on the housing spaced longitudinally therealong adjacent the jaws; each jaw including a pair of slots that respectively receive the pair of pins; the slots of each jaw extending parallel to each other in a skewed relationship to the longitudinal axis of the housing such that the longitudinal jaw movement is accompanied by lateral movement of the jaw engagement surfaces toward or away from each other while maintaining the parallel relationship therebetween in order to provide an adjustable open-end wrench; flared ends on the side walls of the housing adjacent the outer ends of the jaws; said flared ends of the housing side walls each having a slide surface; the outer end of each jaw having a slide surface that is slidably engaged with one of the slide surfaces on the ends of the housing side walls; said slide surfaces defining a flared shape; and a lock mechanism for locking the adjusting member and the jaws against longitudinal movement to control the size of nuts or bolt heads that can be gripped by either the open-end or box-end of the wrench.

15. In an adjustable open-end and box-end wrench including an elongated housing of a hollow construction, said housing having a pair of side walls spaced from each other a uniform distance between the ends of the housing, a polygonal box structure on one end of the housing, an adjusting member received within the housing for longitudinal movement with respect thereto and having an outer engagement surface for cooperating with the box structure to grip nuts and bolt heads of different sizes in accordance with the longitudinal position of the adjusting member so as to thereby provide an adjustable box-end wrench, and a pair of jaws having inner ends connected to the adjusting member within the housing for longitudinal movement therewith and having outer ends with associated engagement surfaces that oppose each other in a parallel relationship, the improvement comprising: a pair of pins mounted on the housing spaced longitudinally therealong adjacent the jaws; each jaw including a pair of slots that respectively receive the pair of pins; the slots of each jaw extending parallel to each other in a skewed relationship to the longitudinal axis of the housing such that the longitudinal jaw movement is accompanied by lateral movement of the jaw engagement surfaces toward or away from each other while maintaining the parallel relationship therebetween in order to provide an adjustable open-end wrench; flared ends on the side walls of the housing adjacent the outer ends of the jaws; said flared ends of the housing side walls each having a slide surface; the outer end of each jaw having a slide surface that is slidably engaged with one of the slide surfaces on the ends of the housing side walls; said slide surfaces defining a flared shape; a slideway on the housing for mounting the adjusting member adjacent the engagement surface thereof for its longitudinal movement and for selective pivotal movement about a lateral axis parallel to the lateral direction of jaw movement; a slidable connection between the adjusting member and the inner ends of the jaws so as to permit the selective pivoting of the adjusting member; and a lock mechanism including a pawl and ratchet that are engaged and disengaged between the housing and the adjusting member upon pivoting of the adjusting member in order to selectively fix the longitudinal position of the adjusting members and the jaws and thereby control the sizes of nuts or bolt heads which can be gripped by either the open-end or box-end of the wrench.

16. In an adjustable open-end and box-end wrench including an elongated housing of a hollow construction, said housing having a pair of side walls spaced from each other a uniform distance between the ends of the housing, a polygonal box structure on one end of the housing, an adjusting member received within the housing for longitudinal movement with respect thereto and having an outer engagement surface for cooperating with the box structure to grip nuts and bolt heads of different sizes in accordance with the longitudinal position of the adjusting member so as to thereby provide an adjustable box-end wrench, and a pair of jaws having inner ends connected to the adjusting member within the housing for longitudinal movement therewith and having outer ends with associated engagement surfaces that oppose each other in a parallel relationship, the improvement comprising: a pair of pins mounted on the housing spaced longitudinally therealong adjacent the jaws; each jaw including a pair of slots that respectively receive the pair of pins; the slots of each jaw extending parallel to each other in a skewed relationship to the longitudinal axis of the housing such that the longitudinal jaw movement is accompanied by lateral movement of the jaw engagement surfaces toward or away from each other while maintaining the parallel relationship therebetween in order to provide an adjustable open-end wrench; flared ends on the side walls of the housing adjacent the outer ends of the jaws; said flared ends of the housing side walls each having a slide surface; the outer end of each jaw having a slide surface that is slidably engaged with one of the slide surfaces on the ends of the housing side walls; said slide surfaces defining a flared shape; a lock mechanism including an adjusting nut; threads on the adjusting member for threadingly receiving the adjusting nut; and an opening in the housing for receiving the adjusting nut such that rotation thereof moves the adjusting member and hence the jaws longitudinally within the housing.

* * * * *

UNITED STATES PATENT AND TRADEMARK OFFICE

CERTIFICATE OF CORRECTION

PATENT NO. : 4,325,275

DATED : April 20, 1982

INVENTOR(S) : David S. Colvin

It is certified that error appears in the above-identified patent and that said Letters Patent is hereby corrected as shown below:

Column 2, line 34, "then" should read -- than --.

Column 7, line 61, "accomplished" should read -- accompanied --.

Signed and Sealed this

*Thirtieth* Day of *November 1982*

[SEAL]

*Attest:*

GERALD J. MOSSINGHOFF

*Attesting Officer*

*Commissioner of Patents and Trademarks*